United States Patent [19]

Nakamura et al.

[11] Patent Number: 4,512,312

[45] Date of Patent: Apr. 23, 1985

[54] VARIABLE VENTURI-TYPE CARBURETOR

[75] Inventors: Norihiko Nakamura; Takaaki Itou; Takashi Katou, all of Mishima; Masatami Takimoto; Mitsuyoshi Teramura, both of Toyota, all of Japan

[73] Assignee: Toyota Jidosha Kabushiki Kaisha, Toyota, Japan

[21] Appl. No.: 465,658

[22] Filed: Feb. 10, 1983

[30] Foreign Application Priority Data

May 18, 1982 [JP] Japan ..... 57-082408

[51] Int. Cl.[3] ..... F02M 7/18

[52] U.S. Cl. ..... 123/439; 123/440; 261/44 C; 261/121 B; 261/DIG. 56

[58] Field of Search ..... 123/438, 439, 440, 437, 123/585, 589; 261/44 C, 121 B, DIG. 56

[56] References Cited

U.S. PATENT DOCUMENTS

| | | | |
|---|---|---|---|
| 3,970,060 | 7/1976 | Sasano | 123/438 |
| 3,981,284 | 9/1976 | Gospodar | 123/438 |
| 4,060,064 | 11/1977 | Minami et al. | 123/440 |
| 4,083,338 | 4/1978 | Bertling et al. | 123/439 |
| 4,097,562 | 6/1978 | Blakeway | 261/41 B |
| 4,136,139 | 1/1979 | Nakamura et al. | 261/44 C |
| 4,144,855 | 3/1979 | Masui et al. | 123/339 |
| 4,208,358 | 6/1980 | Atkins et al. | 261/50 R |
| 4,290,399 | 9/1981 | Takada et al. | 123/439 |
| 4,314,535 | 2/1982 | Takeuchi et al. | 123/439 |
| 4,369,749 | 1/1983 | Sugi | 123/439 |
| 4,371,478 | 2/1983 | Wada | 261/44 C |
| 4,393,012 | 7/1983 | Kato et al. | 261/44 C |

FOREIGN PATENT DOCUMENTS

| | | | |
|---|---|---|---|
| 0156444 | 12/1981 | Japan . | |
| 0156445 | 12/1981 | Japan . | |
| 0065842 | 4/1982 | Japan | 261/44 C |
| 1429270 | 3/1976 | United Kingdom . | |
| 2033483 | 5/1980 | United Kingdom . | |
| 2049821 | 12/1980 | United Kingdom . | |
| 2086988 | 5/1982 | United Kingdom . | |

*Primary Examiner*—Parshotam S. Lall
*Assistant Examiner*—W. R. Wolfe
*Attorney, Agent, or Firm*—Finnegan, Henderson, Farabow, Garrett & Dunner

[57] ABSTRACT

A variable venturi-type carburetor comprising a metering jet and at least one air-bleed bore formed on the cylindrical inner wall of the metering jet. The amount of air fed into the fuel passage of the carburetor from the air-bleed bore is controlled by an output signal from the oxygen concentration detector arranged in the exhaust manifold so that the air-fuel ratio of the mixture fed into the cylinder of the engine becomes equal to the stoichiometric air-fuel ratio. The metering needle is arranged so that it contacts the cylindrical inner wall of the metering jet and partially covers the air-bleed bore.

6 Claims, 18 Drawing Figures

VARIABLE VENTURI-TYPE CARBURETOR

BACKGROUND OF THE INVENTION

The present invention relates to a variable venturi-type carburetor.

A variable venturi-type carburetor normally comprises a suction piston which changes the cross-sectional area of the venturi portion of the carburetor in response to a change in the amount of air fed into the cylinder of the engine, a needle connected to the suction piston, a fuel passage extending in the axial direction of the needle so that the needle is able to enter into the fuel passage, and a metering jet arranged in the fuel passage and cooperating with the needle. In addition, there is known a variable venturi-type carburetor in which the air-fuel ratio of the mixture fed into the cylinder of the engine is controlled so that it is equal to the stoichiometric air-fuel ratio. This variable venturi-type carburetor comprises an air-bleed passage connected to the fuel passage and an electromagnetic control valve arranged in the air-bleed passage and actuated in response to an output signal from an oxygen concentration detector arranged in the exhaust passage of the engine. In this variable venturi-type carburetor, the air-fuel ratio of the mixture fed into the cylinder of the engine is made equal to the stoichiometric air-fuel ratio by gradually decreasing the amount of air fed into the fuel passage from the air-bleed passage when the air-fuel ratio of the mixture becomes greater than the stoichiometric air-fuel ratio and by gradually increasing the amount of air fed into the fuel passage from the air-bleed passage when the air-fuel ratio of the mixture becomes less than the stoichiometric air-fuel ratio. However, in a case where the air-bleed passage is connected to the fuel passage, the range of fluctuation of the air-fuel ratio, which fluctuation occurs when the flow area of the air-bleed passage varies by a certain degree, varies in accordance with the amount of fuel flowing within the fuel passage. That is, when the amount of air fed into the cylinder of the engine is large, that is, when the amount of fuel flowing within the fuel passage is large, the air-fuel ratio is not changed very much even if the flow area of the air-bleed passage is considerably changed. However, when the amount of air fed into the cylinder of the engine is small, that is, when the amount of fuel flowing within the fuel passage is small, if the flow area of the air-bleed passage is slightly changed, the air-fuel ratio is considerably changed. Consequently, in the conventional carburetor, in a case where the amount of fuel flowing within the fuel passage is small, when the air-fuel ratio becomes greater than the stoichiometric air-fuel ratio, and thus the amount of air fed into the fuel passage from the air-bleed passage is gradually decreased, the air-fuel ratio becomes considerably small. This results in a problem in that the air-fuel ratio considerably fluctuates.

SUMMARY OF THE INVENTION

An object of the present invention is to provide a variable venturi-type carburetor capable of minimizing the range of fluctuation of the air-fuel ratio regardless of the amount of air fed into the cylinder of the engine and capable of keeping the air-fuel ratio equal to or nearly equal to the stoichiometric air-fuel ratio.

According to the present invention, there is provided a variable venturi-type carburetor of an internal-combustion engine having a cylinder, an exhaust passage, and an oxygen concentration detector arranged in the exhaust passage, the carburetor comprising: an intake passage formed in the carburetor; a suction piston transversely movable in the intake passage in response to a change in the amount of air flowing within the intake passage, the suction piston having a tip face which defines the venturi in the intake passage; a fuel passage extending transversely and being open to the intake passage; a metering jet arranged in the fuel passage and having a cylindrical inner wall and an air-outflow opening formed on the cylindrical inner wall; an air-bleed passage through which the air-outflow opening is open to the outside air; valve means arranged in the air-bleed passage and actuated in response to an output signal from the oxygen concentration detector so as to keep the air-fuel ratio of the mixture fed into the cylinder equal to a predetermined ratio; and a needle fixed onto the tip face of the suction piston and having a cross-sectional area increasing in the direction of the tip face of the suction piston, the needle extending through the fuel passage and the metering jet and partially covering the air-outflow opening so as to reduce the flow area of the air-outflow opening in accordance with a reduction in the amount of air fed into the cylinder.

The present invention may be more fully understood from the description of the preferred embodiments set forth below, together with the accompanying drawings.

DESCRIPTION OF THE PREFERRED EMBODIMENTS

Figure 1:
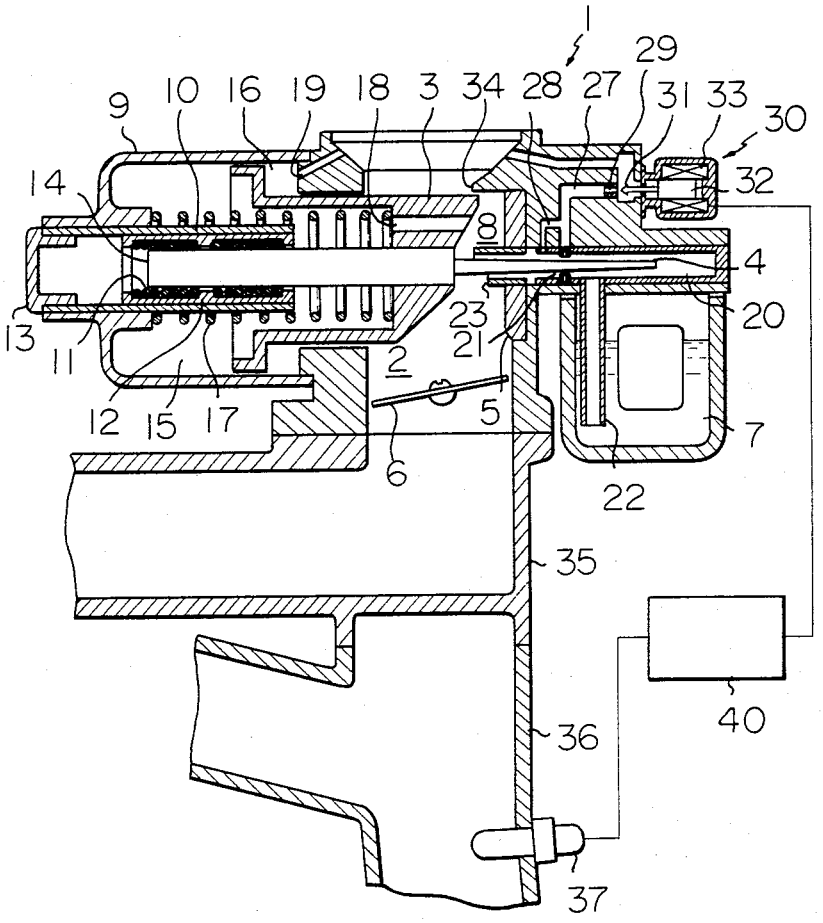
FIG. 1 is a cross-sectional side view of the intake system of an engine.

Referring to FIG. 1, reference numeral 1 designates a carburetor body, 2 a vertically-extending intake passage, 3 a suction piston transversely movable in the intake passage 2, 4 a needle fixed onto the tip face of the suction piston 3, 5 a spacer fixed onto the inner wall of the intake passage 2 and arranged so as to face the tip face of the suction piston 3, 6 a throttle valve located downstream of the suction piston 3 in the intake passage 2, and 7 the float chamber of the carburetor. A venturi 8 is formed between the spacer 5 and the tip face of the suction piston 3. A hollow cylindrical casing 9 is fixed onto the carburetor body 1, and a guide sleeve 10, extending within the casing 9 in the axial direction of the casing 9, is attached to the casing 9. A bearing 12, equipped with a plurality of balls 11, is inserted into the guide sleeve 10, and the outer end of the guide sleeve 10 is closed with a blind cap 13. A guide rod 14 is fixed onto the suction piston 3 and is inserted into the bearing 12 so as to be movable in the axial direction thereof. Since the suction piston 3 is supported by the casing 9 via the bearing 12, the suction piston 3 is able to move smoothly in the axial direction thereof. The interior of the casing 9 is divided into a vacuum chamber 15 and an atmospheric pressure chamber 16 by the suction piston 3, and a compression spring 17 for continuously biasing the suction piston 3 towards the venturi 8 is inserted into the vacuum chamber 15. The vacuum chamber 15 is connected to the venturi 8 via a suction hole 18 formed in the suction piston 3, and the atmospheric pressure chamber 16 is connected to the intake passage 2 upstream of the suction piston 3 via an air hole 19 formed in the carburetor body 1.

A fuel passage 20 is formed in the carburetor body 1 and extends in the axial direction of the needle 4 so that the needle 4 can enter into the fuel passage 20. A metering jet 21 is arranged in the fuel passage 20. The fuel passage 20, located upstream of the metering jet 21, is connected to the float chamber 7 via a downwardly-extending fuel pipe 22, and fuel in the float chamber 7 is fed into the fuel passage 20 via the fuel pipe 22. In addition, a hollow cylindrical nozzle 23, arranged coaxially to the fuel passage 20, is fixed onto the spacer 5. The nozzle 23 projects from the inner wall of the spacer 5 into the venturi 8, and, in addition, the upper half of the tip portion of the nozzle 23 projects beyond the lower half of the tip portion of the nozzle 23 towards the suction piston 3. The needle 4 extends through the interior of the nozzle 23 and the metering jet 21, and fuel is fed into the intake passage 2 from the nozzle 23 after it is metered by an annular gap formed between the needle 4 and the metering jet 21.

Figure 2:
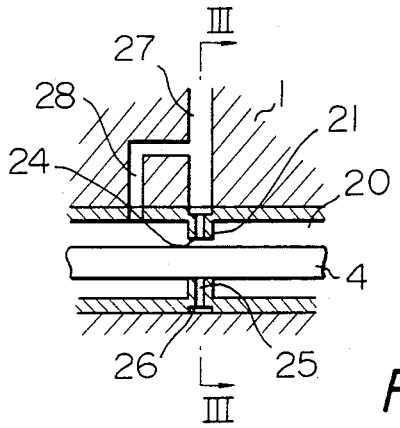
FIG. 2 is a cross-sectional side view of a portion of an embodiment of a carburetor according to the present invention.
Figure 3:
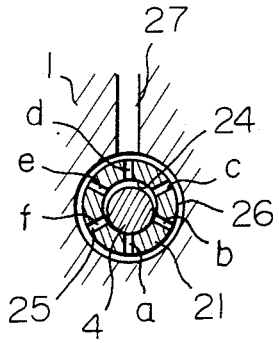
FIG. 3 is a cross-sectional view along the line III—III in FIG. 2.

Referring to FIGS. 1 through 3, a plurality of air-bleed bores 25 are formed on the cylindrical inner circumferential wall 24 of the metering jet 21. The air bleed-bores 25 extend in the radial direction of the metering jet 21 and are equidistantly arranged along the cylindrical inner circumferential wall 24. An annular passage 26 is formed around the metering jet 21, and the air-bleed bores 25 are connected to the annular passage 26. The annular passage 26 is connected, via an air-bleed passage 27 formed in the carburetor body 1, to the intake passage 2 upstream of the suction piston 3. An auxiliary air-bleed passage 28 is branched off from the air-bleed passage 27 and is open to the fuel passage 20 downstream of the metering jet 21. As is illustrated in FIG. 1, a valve port 29 is formed in the air-bleed passage 27, and an electromagnetic control valve 30 is fixed onto the carburetor body 1. The electromagnetic control valve 30 comprises a valve body 31 which controls the flow area of the valve port 29, a movable plunger 32 connected to the valve body 31, and a solenoid 33 which attracts the movable plunger 32. The solenoid 33 is connected to the output terminal of an electronic control unit 40. The flow area of the valve port 29 increases as the width of the pulse supplied to the solenoid 33 increases and decreases as the width of the pulse supplied to the solenoid 33 decreases.

As is also illustrated in FIG. 1, a raised wall 34, projecting horizontally into the intake passage 2, is formed at the upper end of the spacer 5, and a flow control is effected between the raised wall 34 and the tip end portion of the suction piston 3. When the engine is started, air flows downwards within the intake passage 2. At this time, since the airflow is restricted between the suction piston 3 and the raised wall 34, a vacuum is created in the venturi 8. This vacuum affects the vacuum chamber 15 via the suction hole 18, and the suction piston 3 moves so that the pressure difference between the vacuum in the vacuum chamber 15 and the pressure in the atmospheric pressure chamber 16 becomes approximately equal to a fixed value determined from the spring force of compression spring 17, that is, the level of vacuum created in the venturi 8 remains approximately constant.

In FIG. 1, the carburetor body 1 is mounted on an intake manifold 35, and an exhaust manifold 36 is arranged beneath the intake manifold 35. An oxygen concentration detector 37 is arranged in the exhaust manifold 36 and is connected to the input terminal of the electronic control unit 40.

Figure 7:
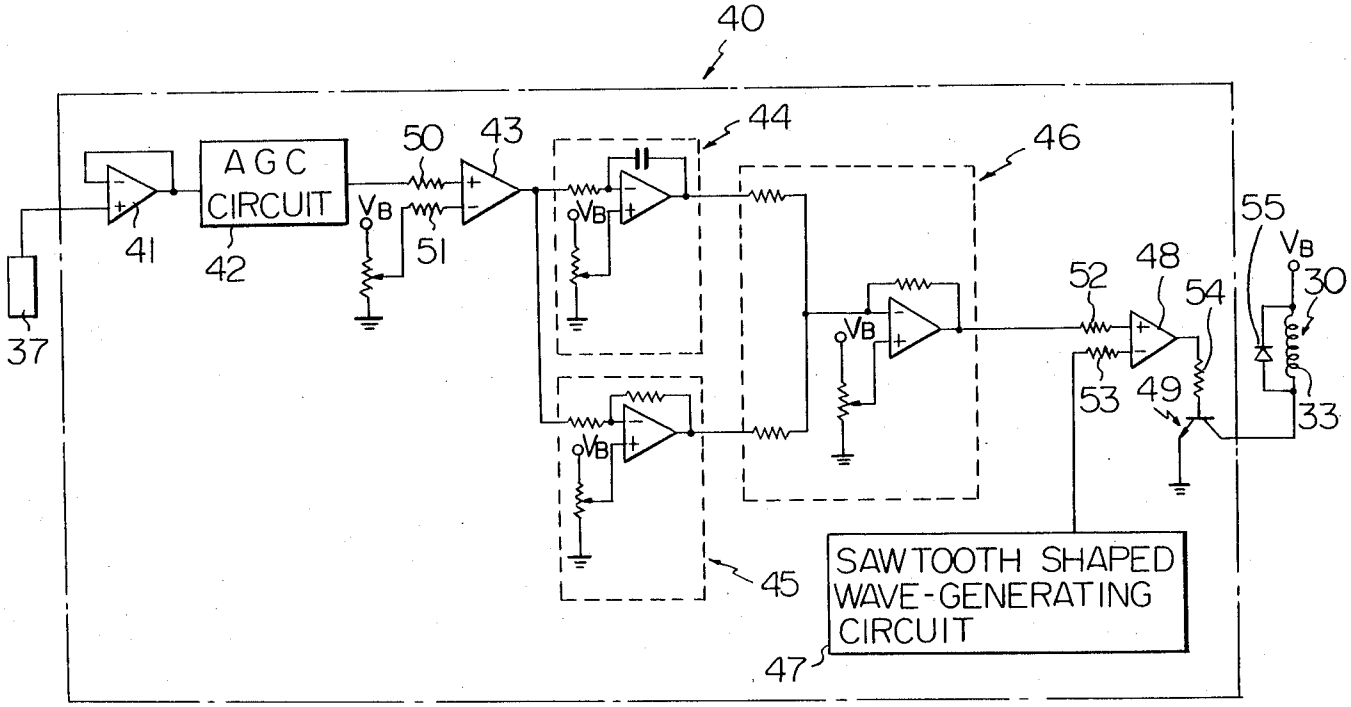
FIG. 7 is a circuit diagram of an electronic control unit.
Figure 9:
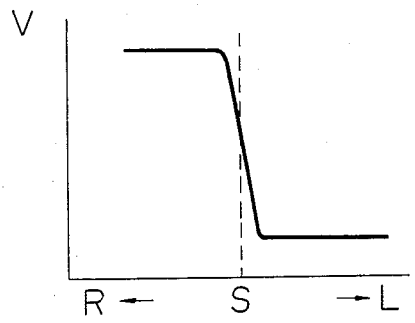
FIG. 9 is a diagram illustrating the output voltage of an oxygen concentration detector.

FIG. 7 illustrates a circuit diagram of the electronic control unit 40. In FIG. 7, $V_B$ indicates a power supply voltage, and the oxygen concentration detector 37 is depicted as a block. As can be seen from FIG. 9, the oxygen concentration detector 37 produces an output voltage of about 0.1 volts when the air-fuel ratio of the mixture fed into the cylinder of the engine is greater than the stoichiometric air-fuel ratio and produces an output voltage of 0.9 volts when the air-fuel ratio of the mixture fed into the cylinder of the engine is less than the stoichiometric air-fuel ratio. In FIG. 9, the ordinate V indicates the output voltage of the oxygen concentration detector 37, and the abscissa indicates the air-fuel ratio of the mixture fed into the cylinder of the engine. In addition, in the abscissa, S indicates the stoichiometric air-fuel ratio, and L and R indicate the lean side and the rich side of the stoichiometric air fuel ratio, respectively.

Referring back to FIG. 7, the electronic control unit 40 comprises a voltage follower 41, an automatic gain control (AGC) circuit 42, a first comparator 43, an integrating circuit 44, a proportional circuit 45 formed by an inverting amplifier, an adder circuit 46, a sawtooth shaped wave-generating circuit 47, a second comparator 48, and a transistor 49. The output terminal of the oxygen concentration detector 37 is connected to the non-inverting input terminal of the voltage follower 41, and the output terminal of the voltage follower 41 is connected to the input terminal of the AGC circuit 42. The output terminal of the AGC circuit 42 is connected to the non-inverting input terminal of the first comparator 43 via a resistor 50, and a reference voltage of about 0.4 volts is applied to the inverting input terminal of the first comparator 43 via a resistor 51. The output terminal of the first comparator 43 is connected, on the one hand, to the input terminal of the integrating circuit 44 and, on the other hand, to the input terminal of the proportional circuit 45. The output terminal of the integrating circuit 44 is connected to a first input terminal of the adder circuit 46, and the output terminal of the proportional circuit 45 is connected to a second input terminal of the adder circuit 46. The output terminal of the adder circiut 46 is connected to the non-inverting input terminal of the second comparator 48 via a resistor 52, and the inverting input terminal of the second comparator 48 is connected to a sawtooth shaped wave-generating circuit 47 via a resistor 53. The output terminal of the second comparator 48 is connected to the base of a transistor 49 via a resistor 54. The emitter of the transistor 49 is grounded, and the collector of the transistor 49 is connected to the solenoid 33 of the electromagnetic control valve 30 (FIG. 1). In addition, a diode 55 for absorbing surge current is connected, in parallel, to the solenoid 33.

Figure 8:
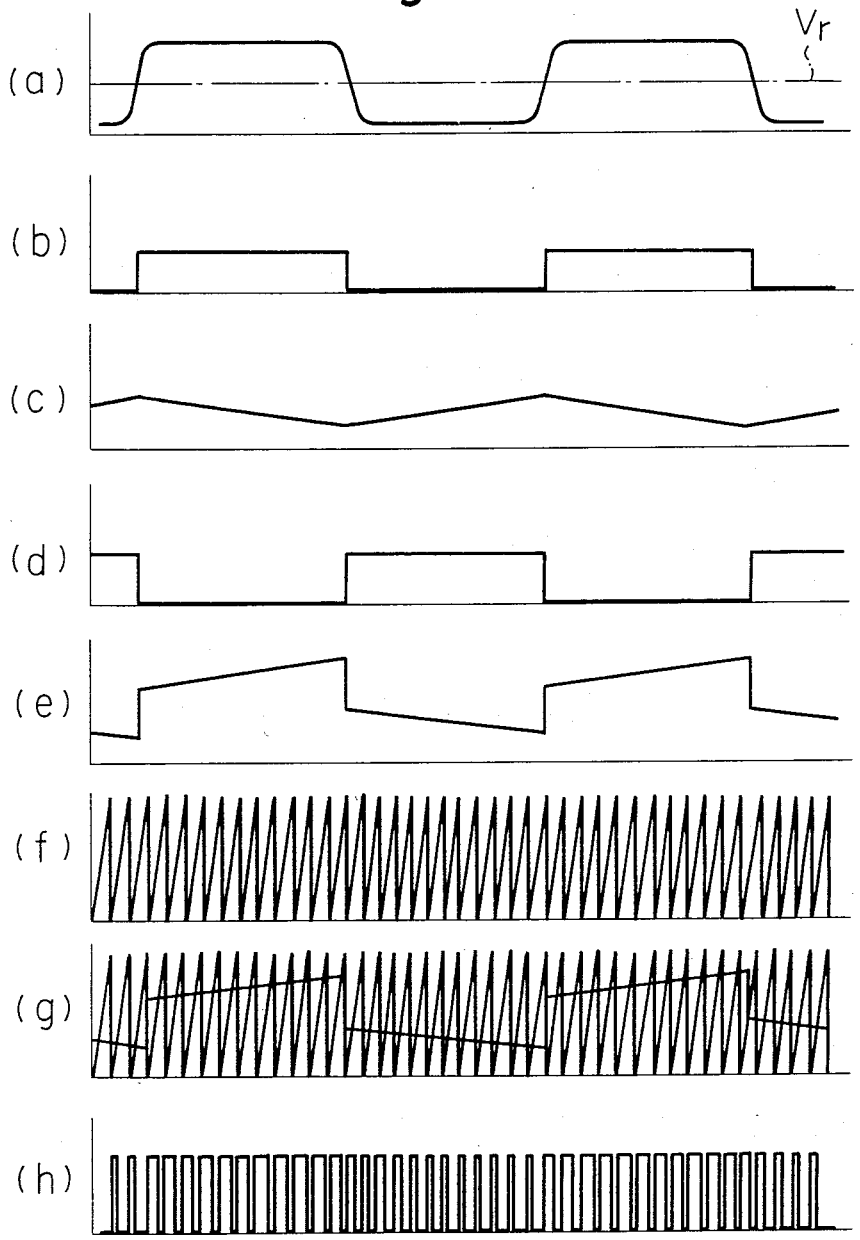
FIGS. 8*a*–8*h* are time charts illustrating the operation of the electronic control unit in FIG. 7.

The output signal of the oxygen concentration detector 37 is fed into the AGC circuit 42 via the voltage follower 41. The AGC circuit 42 is an amplifier which is so constructed that the gain of the amplifier is increased as the mean value of the output voltage of the oxygen concentration detector 37 is decreased. Therefore, the AGC circuit 42 produces an output voltage which is changed proportionally to the output voltage of the oxygen concentration detector 37, with the mean value of the output voltage of the AGC circuit 42 being kept constant. FIG. 8(*a*) illustrates the output voltage of the AGC circuit 42. In FIG. 8(*a*), $V_r$ indicates the reference voltage applied to the inverting input terminal of the first comparator 43. The first comparator 43 produces a high level output when the output voltage of the AGC circuit 42 exceeds the reference voltage $V_r$. Thus, the first comparator 43 produces the output voltage illustrated in FIG. 8(*b*). The output voltage of the first comparator 43 is integrated in the integrating circuit 44, and, as a result, the integrating circuit 44 produces the output voltage illustrated in FIG. 8(*c*). On the other hand, in the proportional circuit 45, the output voltage of the first comparator 43 is inverted and amplified, and, thus, the proportional circuit 45 produces the output voltage illustrated in FIG. 8(*d*). The output voltage of the integrating circuit 44 and the output voltage of the proportional circuit 45 are added in the adder circuit 46, and, thus, the adder circuit 46 produces the output voltage illustrated in FIG. 8(*e*). The sawtooth shaped wave-generating circuit 47 produces a sawtooth shaped output voltage of a fixed frequency, as is illustrated in FIG. 8(*f*). The output voltage of the adder circuit 46 and the output voltage of the sawtooth shaped wave-generating circuit 47 are compared in the second comparator 48, as is illustrated in FIG. 8(*g*). The second comparator 48 produces a high level output when the output voltage of the adder circuit 46 becomes greater than that of the sawtooth shaped wave-generating circuit 47. Consequently, the second comparator 48 produces continuous pulses, as is illustrated in FIG. 8(*h*), and the widths of the continuous pulses are proportional to the level of the output voltage of the adder circuit 46. The energizing operation of the solenoid 33 is controlled by the continuous pulses, and the flow area of the valve port 29 is increased as the widths of the continuous pulses are increased. From FIG. 8, it will be understood that when the AGC circuit 42 produces a high level output, that is, when the air-fuel ratio of the mixture fed into the cylinder of the engine becomes less than the stoichiometric air-fuel ratio, the widths of the continuous pulses produced at the output terminal of the second comparator 48 are increased, and, as a result, the flow area of the valve port 29 is increased. When the flow area of the valve port 29 is increased, since the amount of air fed into the fuel passage 20 from the air-bleed bores 25 via the air-bleed passage 27 is increased, the amount of fuel fed from the nozzle 23 into the intake passage 2 is reduced, and, as result, the air-fuel ratio of the mixture fed into the cylinder of the engine becomes large. If the air-fuel ratio of the mixture fed into the cylinder of the engine becomes greater than the stoichiometric air-fuel ratio the AGC circuit 42 (FIG. 7) produces a low level output. As a result since the widths of the continuous pulses produced at the output terminal of the second comparator 48 are reduced, the flow area of the valve port 29 is reduced. Therefore, the amount of air fed into the fuel passage 20 from the air-bleed bores 25 via the air-bleed passage 27 is reduced and, thus, the air-fuel ratio of the mixture fed into the cylinder of the engine becomes small. During operation of the engine, the amount of air fed into the fuel passage 20 from the air-bleed bores 25 is alternately increased and decreased, and, thereby, the air-fuel ratio of the mixture fed into the cylinder of the engine becomes equal to the stoichiometric air-fuel ratio.

Figure 4:
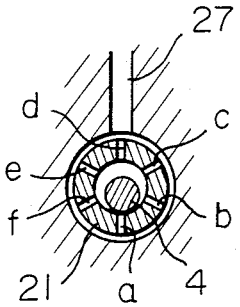
FIG. 4 is also a cross-sectional view along the line III—III in FIG. 2.

In a variable venturi-type carburetor such as the one illustrated in FIG. 1, if the needle 4 moves in the metering jet 21 in a direction which is perpendicular to the axial direction of the needle 4, the area of the annular gap formed between the needle 4 and the metering jet 21 is changed, and, thus, a problem occurs in that even if the suction piston 3 is kept stationary, the amount of fuel flowing within the metering jet 21 is changed. Consequently, in a variable venturi-type carburetor such as the one illustrated in FIG. 1, in order to eliminate such a problem, the needle 4 is normally arranged so that it continuously contacts one side of the inner wall of the metering jet 21. In the embodiment illustrated in FIG. 1, the needle 4 is arranged so that it continuously contacts the bottom portion of the cylindrical inner wall 24 of the metering jet 21. As can be seen from FIG. 1, the needle 4 is formed so that the outer diameter thereof decreases towards the tip, and the suction piston 3 moves to the left as the amount of air fed into the cylinder of the engine is increased. Consequently, when the amount of air fed into the cylinder of the engine is small, the needle 4 occupies a great cross-sectional area within the metering jet 21, as is illustrated in FIG. 3, but the cross-sectional area, occupied by the needle 4 within the metering jet 21, becomes small as the amount of air fed into the cylinder of the engine is increased, as is illustrated in FIG. 4. In the embodiment illustrated in FIGS. 3 and 4, the air-bleed bores 25 are formed by six air-bleed bores a, b, c, d, e, and f and the air-bleed bore a is formed on the bottom portion of the cylindrical inner wall 24 of the metering jet 21. Consequently, as can be seen from FIGS. 3 and 4, the air-bleed bore a is partially covered by the needle 4, and the flow area of the opening of the air-bleed bore a becomes small as the amount of air fed into the cylinder of the engine is reduced. In addition, from FIGS. 3 and 4, it also can be seen that the flow areas of the openings of the air-bleed bores b and f located adjacent to the air-bleed bore a become small as the amount of air fed into the cylinder of the engine is reduced. Consequently, all of the opening areas of the air-bleed bores 25 become small as the amount of air fed into the cylinder of the engine is reduced.

Figure 5:
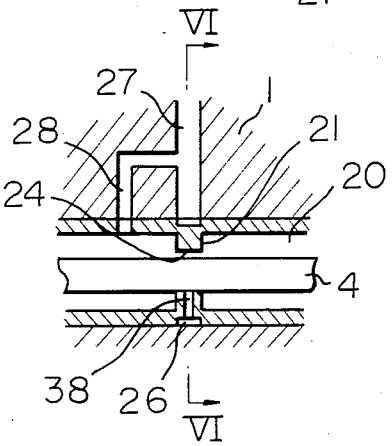
FIG. 5 is a cross-sectional side view of a portion of an alternative embodiment of a carburetor according to the present invention.
Figure 6:
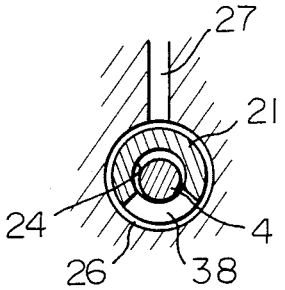
FIG. 6 is a cross-sectional view along the line VI—VI in FIG. 5.

In an alternative embodiment illustrated in FIGS. 5 and 6, a single air-bleed bore 38, formed by a slot having a sector-shaped cross section, is formed on the bottom portion of the cylindrical inner wall 24 of the metering jet 21. The opening of the air-bleed bore 38 is partially covered by the needle 4, and the flow area of the opening of the air-bleed bore 38 becomes smaller as the amount of air fed into the cylinder of the engine is reduced, as in the embodiment illustrated in FIGS. 3 and 4.

Figure 10:
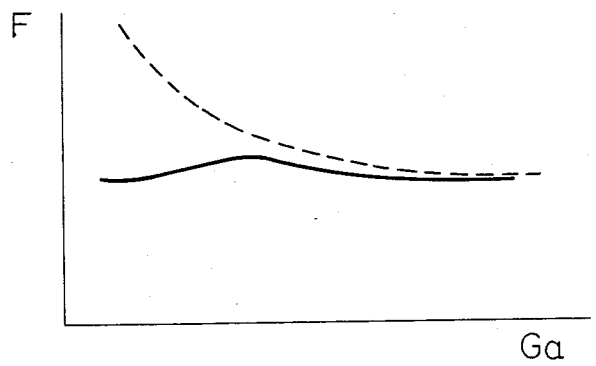
FIG. 10 is a diagram illustrating fluctuation of the air-fuel ratio.
Figure 11:
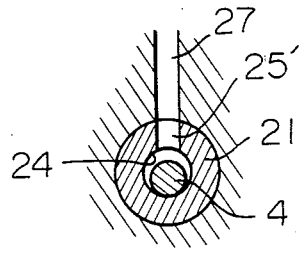
FIG. 11 is a cross-sectional view of a portion of a carburetor.

FIG. 10 illustrates the fluctuation of the air-fuel ratio when the flow area of the air-bleed passage 27 varies by a certain degree. In FIG. 10, the ordinate F indicates fluctuation of the air-fuel ratio of the mixture fed into the cylinder of the engine, and the abscissa Ga indicates the amount of air fed into the cylinder of the engine. For example, as is illustrated in FIG. 11, in a case where a single air-bleed bore 25' is formed on the top portion of the cylindrical inner wall 24 of the metering jet 21, the flow area of the opening of the air-bleed bore 25' is not changed in accordance with a change in the axial position of the needle 4. Consequently, if the flow area of the air-bleed passage 27 is changed when the amount of fuel flowing within the metering jet 21 is small, the air-fuel ratio considerably fluctuates, as is illustrated by the broken line in FIG. 10. Contrary to this, in the present invention, when the amount of air fed into the cylinder of the engine is small, the flow areas of the openings of the air-bleed bores 25 and 38 become small. Consequently, at this time, even if the flow area of the air-bleed passage 27 is increased, the increase in the amount of air fed into the fuel passage 20 from the air-bleed bores 25 and 38 is small. Therefore, in the present invention, even when the amount of air Ga fed into the cylinder of the engine is small, the fluctuation F of the air-fuel ratio is small, as is illustrated by the solid line in FIG. 10.

According to the present invention, fluctuation of the air-fuel ratio F, which fluctuation is caused when the flow area of the air-bleed passage is changed, can be kept approximately constant regardless of the amount of air fed into the cylinder of the engine. As a result, it is possible to keep the air-fuel ratio equal to the stoichiometric air-fuel ratio regardless of the amount of air fed into the cylinder of the engine. The purifying efficiency of the three-way catalyzer is at a maximum when the air-fuel ratio of the mixture fed into the cylinder of the engine is equal to the stoichiometric air-fuel ratio. Consequently, in a case where the three-way catalytic converter is arranged in the exhaust passage of the engine, it is possible to highly purify harmful components in the exhaust gas by keeping the air-fuel ratio equal to the stoichiometric air-fuel ratio.

While the invention has been described with reference to specific embodiments chosen for purposes of illustration, it should be apprarent that numerous modifications could be made thereto by those skilled in the art without departing from the basic concept and scope of the invention.

We claim:

1. A variable venturi-type carburetor of an internal-combustion engine having a cylinder, an exhaust passage, and an oxygen concentration detector arranged in the exhaust passage, said carburetor comprising:

an intake passage formed in the carburetor;

a suction piston transversely movable in said intake passage in response to a change in the amount of air flowing within said intake passage, said suction piston having a tip face which defines the venturi in said intake passage;

a fuel passage extending transversely and being open to said intake passage;

a metering jet arranged in said fuel passage and having a cylindrical inner wall and an air-outflow opening formed on said cylindrical inner wall;

an air-bleed passage through which said air-outflow opening is open to the outside air;

an auxiliary air-bleed passage branching from said air-bleed passage and being open to said fuel passage downstream of said metering jet;

valve means arranged in said air-bleed passage and actuated in response to an output signal from the oxygen concentration detector so as to keep the air-fuel ratio of the mixture fed into the cylinder equal to a predetermined ratio; and a needle fixed onto the tip face of said suction piston and having a cross-sectional area which increases in the direction f the tip face of said suction piston, said needle extending through said fuel passage and said metering jet and partially covering said air-outflow opening so as to reduce the flow are of said air-outflow opening in accordance with a reduction in the amount of air fed into the cylinder.

2. A variable venturi-type carburetor according to claim 1, wherein a raised wall is formed on an inner wall of said intake passage opposite to the tip face of said suction piston, said tip face having an upstream end portion which cooperates with said raised wall so as to restrict the air flowing within said venturi.

3. A variable venturi-type carburetor according to claim 1, wherein said air-outflow opening comprises a plurality of air-bleed bores formed on the cylindrical inner wall of said metering jet, said needle continuously contacting a portion of said cylindrical inner wall and partially covering at least one of said air-bleed bores.

4. A variable venturi-type carburetor according to claim 3, therein said air-bleed bores are equidistantly arranged on the cylindrical inner wall of said metering jet.

5. A variable venturi-type carburetor according to claim 1, wherein said air-flow opening comprises a single air-bleed bore formed on the cylindrical inner wall of said metering jet, said needle continuously contacting a portion of said cylindrical inner wall and partially covering said air-bleed bore.

6. A variable venturi-type carburetor according to claim 5, wherein said air-bleed bore is formed by a slot extending in the circumferential direction of the cylindrical inner wall of said metering jet.

* * * * *